United States Patent [19]

Tella et al.

[11] Patent Number: 4,650,095

[45] Date of Patent: Mar. 17, 1987

[54] DISPOSABLE WALL-MOUNTED DISPENSING CONTAINER

[75] Inventors: Sherwood T. Tella, Los Angeles; Allan L. Cameron, Topanga; John von Buelow, Northridge; Stephen G. Hauser, Tarzana, all of Calif.

[73] Assignee: United States Borax & Chemical Corporation, Los Angeles, Calif.

[21] Appl. No.: 763,260

[22] Filed: Aug. 7, 1985

[51] Int. Cl.[4] ..... B67D 5/06

[52] U.S. Cl. ..... 222/153; 222/181; 222/379

[58] Field of Search ..... 222/173, 191, 180, 181, 222/185, 372, 376, 379, 381, 383, 385, 341, 153, 340, 341, 511, 513; 417/498; 248/553, 551

[56] References Cited

U.S. PATENT DOCUMENTS

| | | | |
|---|---|---|---|
| 920,931 | 5/1909 | Donnelly | 222/341 |
| 1,164,754 | 12/1915 | Rose | 222/383 |
| 1,558,844 | 10/1925 | Cronin | 222/181 |
| 2,605,021 | 7/1952 | Churchill et al. | 222/181 |
| 3,178,059 | 4/1965 | Packwood, Jr. | 222/181 |
| 3,220,616 | 11/1965 | Jennings | 222/181 |
| 4,165,824 | 8/1979 | Sud | 222/385 |
| 4,166,553 | 9/1979 | Fraterrigo | 222/181 |
| 4,343,417 | 8/1982 | Corsette | 222/153 |
| 4,461,445 | 6/1984 | Williamson et al. | 222/181 |
| 4,493,440 | 1/1985 | Buelow et al. | 222/181 |
| 4,566,611 | 1/1986 | Sukopp | 222/153 |

*Primary Examiner*—Joseph J. Rolla
*Assistant Examiner*—Kenneth Noland
*Attorney, Agent, or Firm*—James R. Thornton; Eric P. Schellin; Jerome J. Norris

[57] ABSTRACT

A disposable wall-mounted dispensing container is disclosed. The container fits into a wall-mounted bracket. A button near the bottom of the container body serves as both measuring chamber to accurately allocate the portion and piston to deliver the portion.

3 Claims, 39 Drawing Figures

FIG. 1
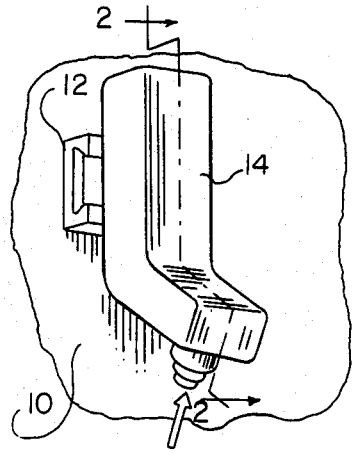
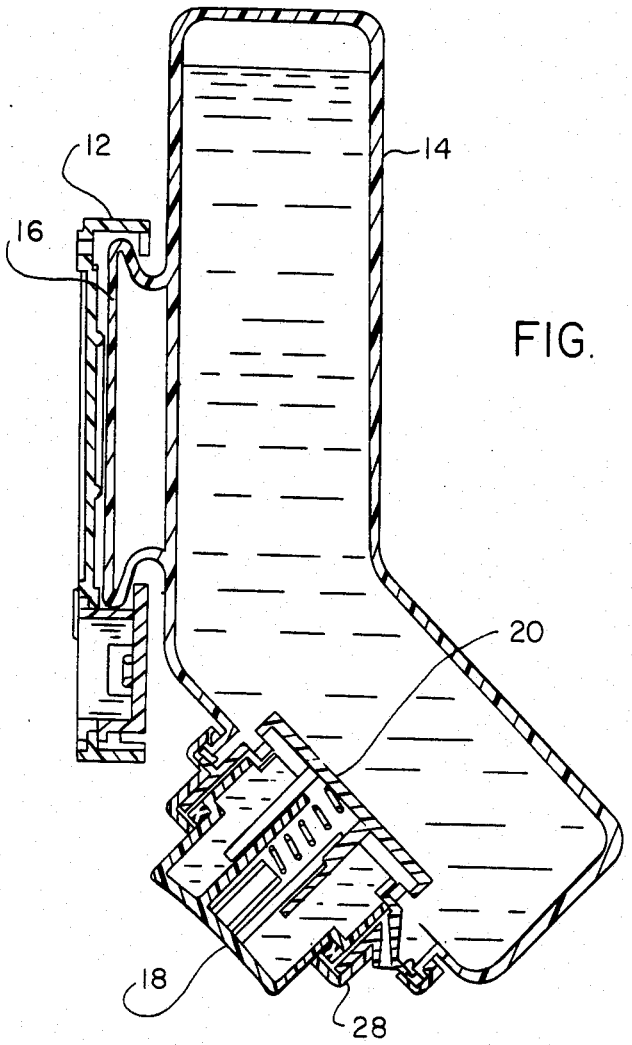
FIG. 2

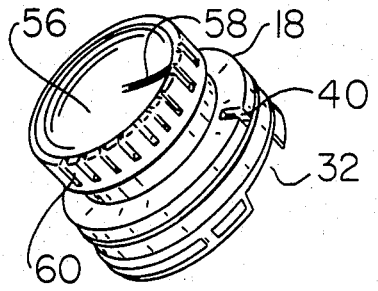
FIG. 6
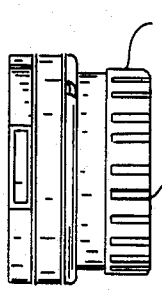
FIG. 7
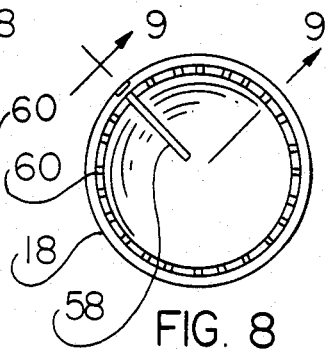
FIG. 8
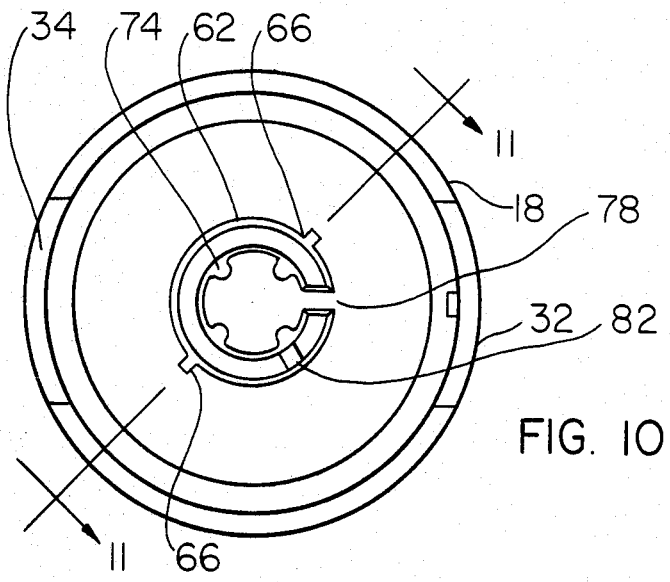
FIG. 10
FIG. 9
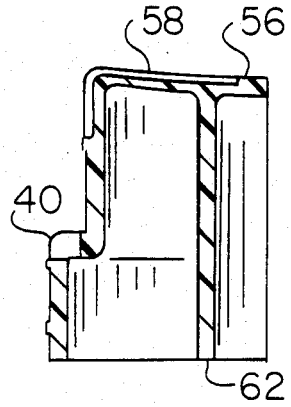
FIG. 11
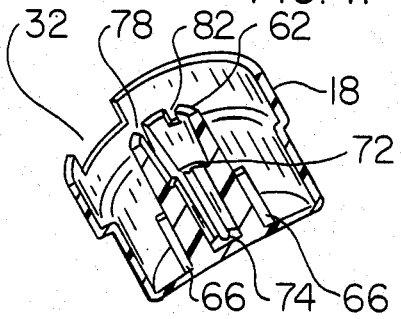

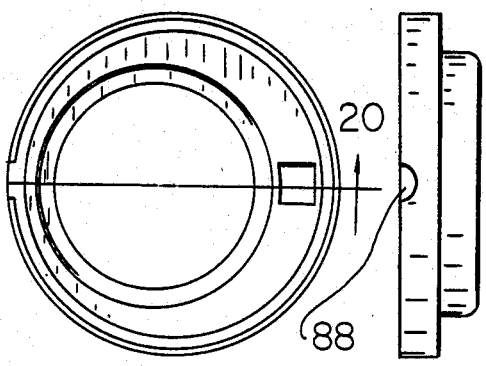
FIG. 17
FIG. 18
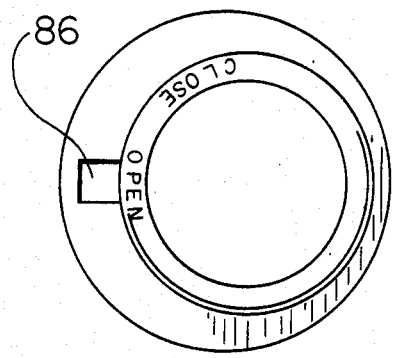
FIG. 19
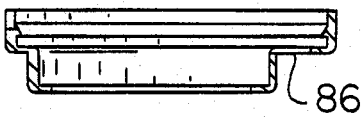
FIG. 20
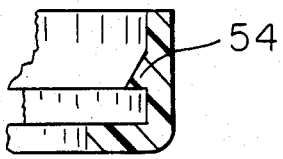
FIG. 21
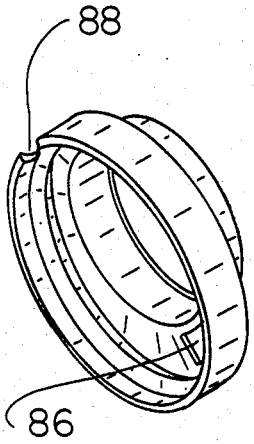
FIG. 22
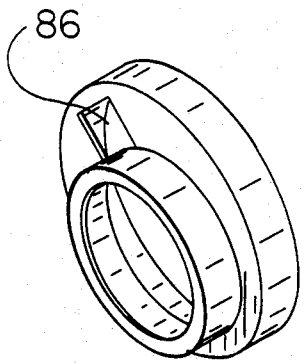
FIG. 23

FIG. 26
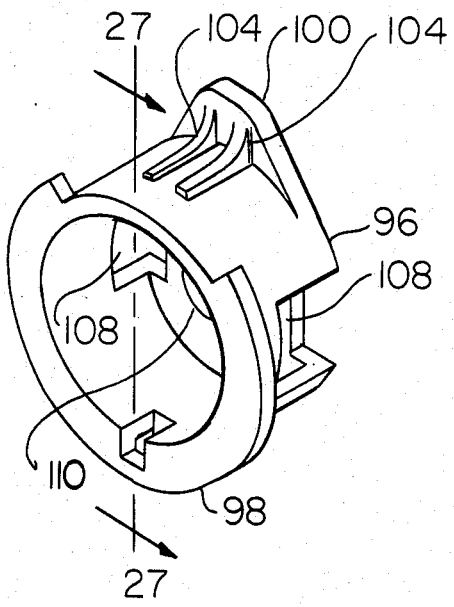
FIG. 27
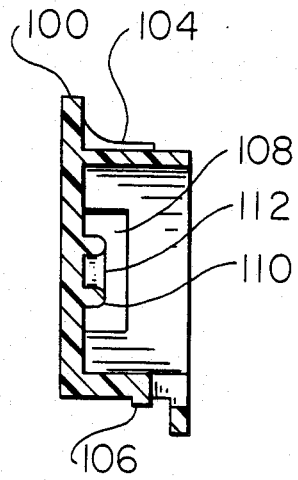
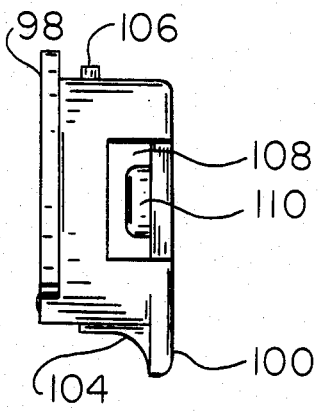
FIG. 28
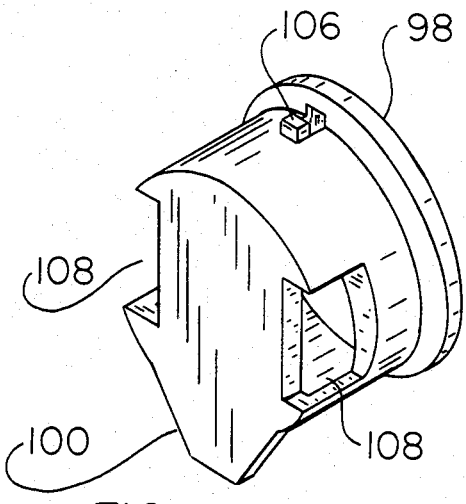
FIG. 29

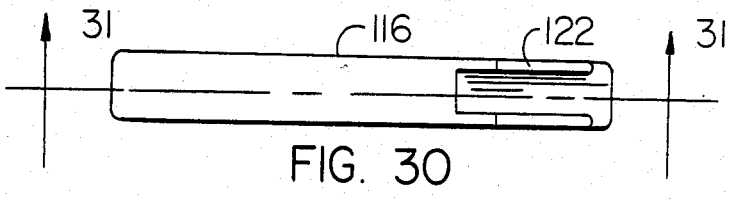
FIG. 30
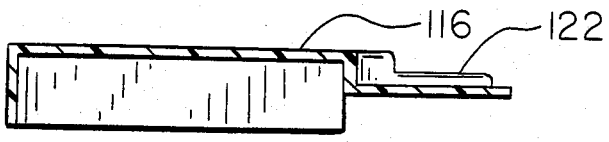
FIG. 31
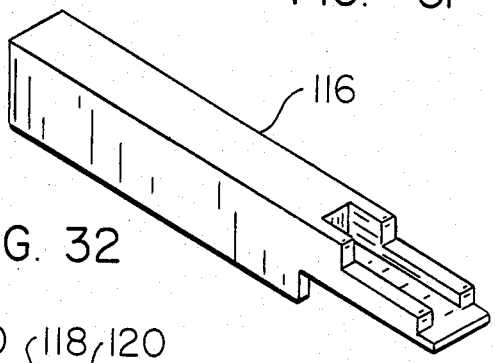
FIG. 32
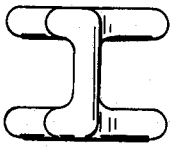
FIG. 33
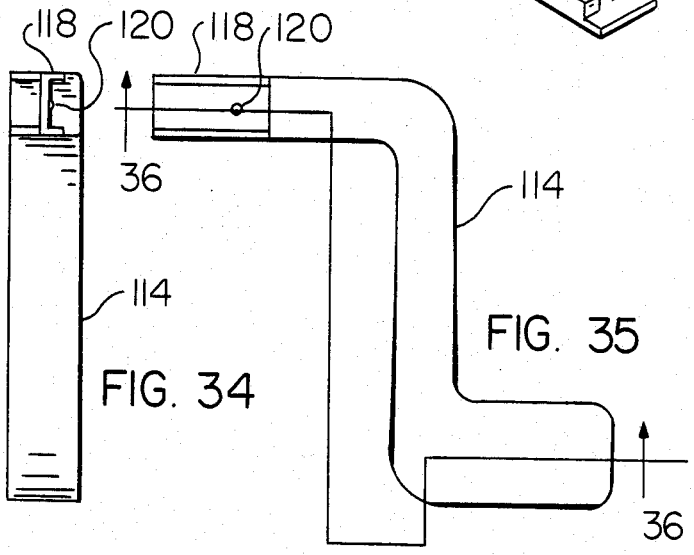
FIG. 34
FIG. 35
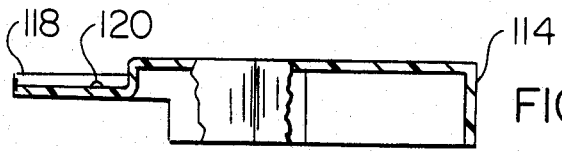
FIG. 36

DISPOSABLE WALL-MOUNTED DISPENSING CONTAINER

FIELD OF THE INVENTION

This invention pertains to disposable wall-mounted containers for dispensing small uniform quantities of liquids and semi-fluids such as soaps, creams, pastes and lubricants directly in the hand or hands of an individual.

BACKGROUND OF THE INVENTION

The use of disposable containers for soaps, creams and cosmetic products has become widespread. The usual disposable container has a simple opening at the top making it difficult to accurately allocate a portion of the fluid without a separate measuring device. A further difficulty in the use of disposable containers is that there is often nowhere to support such containers in washrooms where they are used.

In workshops, laboratories, repair shops and similar working zones, clean-up areas have been set aside. Such clean-up rooms are frequented by many individuals who require access, for instance, to cleansing material. Providing soap and detergent bars for multiple use poses many problems as many individuals dislike employing a soap bar which had been used only a short time before by someone else, who may leave a wet soggy soap bar. To obviate this problem to a degree, powdered soap dispensers have been provided. These powdered soap dispensers are not usually useful in dispensing a paste material, as the powdered soap dispensers usually depend upon gravity flow for successful operation. Unless there is provision for positive pumping action, the paste, if very viscous, will be dispensed at an extremely slow rate, if at all.

Cleansing paste or liquid has certain advantages over the powdered soap. For instance, powdered soap may cake in the hands and may require vigorous rubbing with water before it becomes solubilized and loses its grittiness. On the other hand, cleansing paste or liquid is usually already partially emulsified in a diluent resulting in quick further dispersal. Instead of dispensing cleansing paste, it is oftentimes desirable to provide for small quantities of a lotion material which is applied to the hands as a protection and barrier to dirt.

PRIOR PRACTICE

The prior art devices, when dispensing paste, for instance, are useful but usually possess a reservoir that must be filled from a container. Also, as there is often no positive pumping action a complex follower and pressurizing system is required. The pressurizing is usually accomplished by a floating piston which is spring urged to compress the paste. It will be appreciated that such means will result in mechanical difficulties and is subject to undue wear and fairly rapid breakdown.

Liquid soap dispensing devices have been typically non-disposable metal devices using gravity feed from a volume measuring chamber. U.S. Pat. No. 1,496,549 to Kooperstein is an example. Such devices are complicated and expensive to build, clean and maintain.

There exists a need to synthesize the technology of inexpensive disposable containers with the technology of measuring, wall-mounted dispensers. One attempt at such a synthesis is shown in U.S. Pat. No. 4,166,553 to Fraterrigo for a disposable wall-mounted dispenser having deformable rubber teat on the bottom of the container, which when pressed by a user's finger compresses and forces liquid through a dispensing slit in the bottom thereof.

SUMMARY OF THE INVENTION

The objects of the present invention are to provide a disposable dispensing container which apportions the liquid to be dispensed in a predetermined quantity with automatic closure of the container and with mean for attaching the container to a vertical surface such as a wall.

These objects are achieved by fashioning a hollow spring-restored button near the bottom of the container, the button serving as both measuring chamber to accurately allocate the portion and piston to deliver the portion. A fitting on the side of the container slides into a bracket attached to a vertical surface to provide storage and easy accessability. The button is sloped relative to the container and the interior of the button is shaped at the top so as to eliminate the volume into which air can be sucked back into the button. The button may be locked so that it cannot be depressed by turning the bottom to an "off" position.

These and further constructional and operational characteristics of the invention will be more evident from the detailed description given hereinafter with reference to the figures of the accompanying drawings which illustrate preferred embodiments of non-limiting examples.

BRIEF DESCRIPTION OF THE DRAWINGS

FIG. 1 is a perspective view of the invention attached to a fixed vertical surface.

FIG. 2 is a section along the line 2—2 of FIG. 1.

FIG. 6 is a perspective view of the button.

FIG. 7 is a side view of the button.

FIG. 8 is a top view of the button.

FIG. 9 is a sectional view of the button along the line 9—9 in FIG. 8.

FIG. 10 is an enlarged bottom view of the button.

FIG. 11 is a sectional view of the button along the line 11—11 in FIG. 10.

FIG. 17 is a bottom view of the button holder.

FIG. 18 is a side view of the button holder.

FIG. 19 is a top view of the button holder.

FIG. 20 is a sectional view of the button holder along the line 20—20 in FIG. 17.

FIG. 21 is a section of the right end of FIG. 20.

FIG. 22 is a perspective view from the rear of the button holder.

FIG. 23 is a perspective view from the front of the button holder.

FIG. 26 is a perspective view of the latch from the rear.

FIG. 27 is a cross-section of the latch along the line 27—27 in FIG. 26.

FIG. 28 is a side view of the latch.

FIG. 29 is a perspective view of the latch from the front.

FIG. 30 is a top view of the tool.

FIG. 31 is a sectional view of the tool along the line 31—31 in FIG. 30.

FIG. 32 is a perspective view of the tool.

FIG. 33 is an end view of the tool.

FIG. 34 is an end view of the lever.

FIG. 35 is a front view of the lever.

FIG. 36 is a partial section of the lever along the line 36—36 in FIG. 35.

DESCRIPTION OF THE PREFERRED EMBODIMENT

Figures 3, 4:
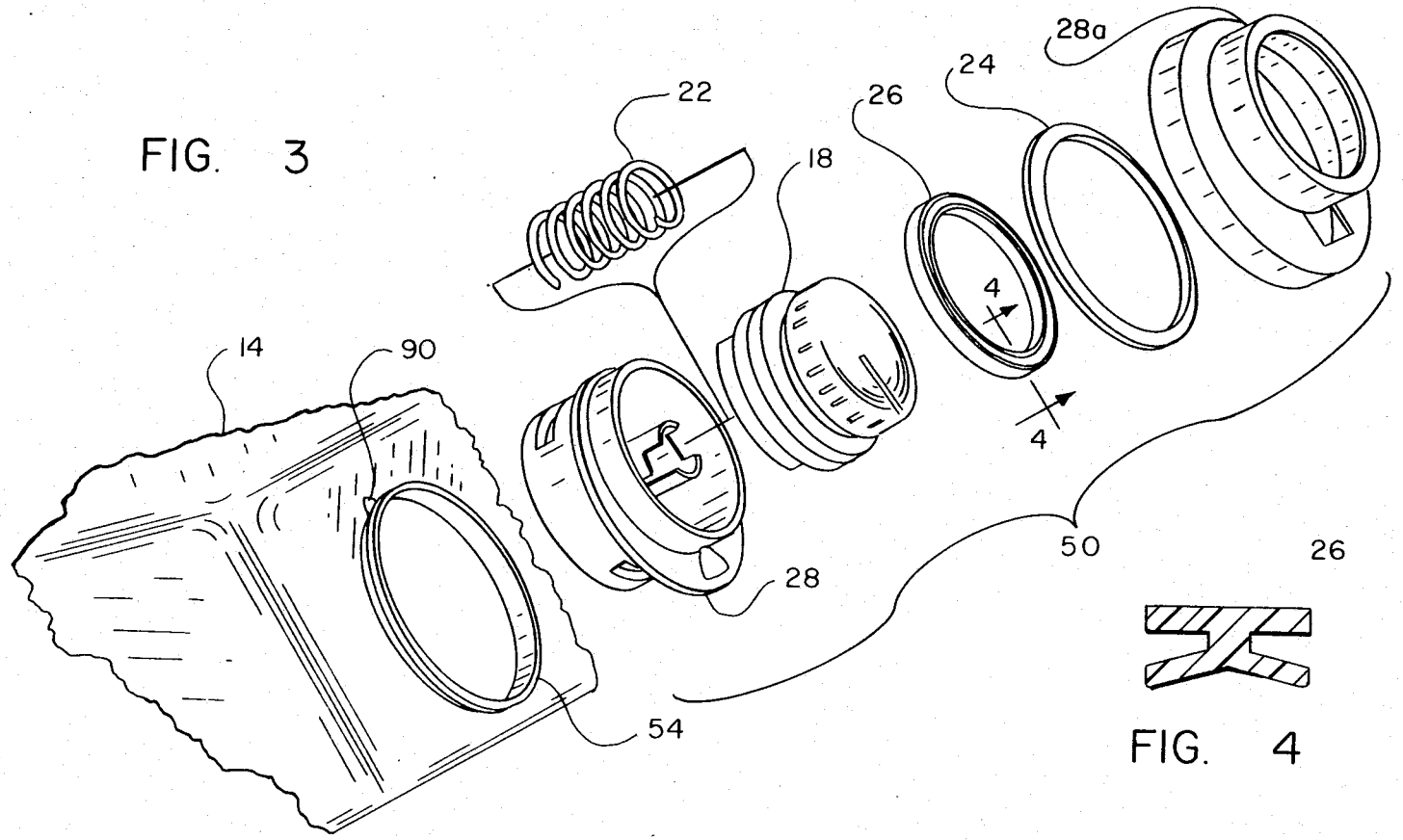
FIG. 3 is a blowup of the drawing of the button.
FIG. 4 is a blowup of a sectional view of the gasket along the line 4—4 of FIG. 3.

Referring now to the drawings wherein reference numerals are used to designate parts throughout the various figures thereof, there is shown in FIG. 1 a wall or vertical surface 10 to which a socket 12 has been attached by suitable means such as adhesive or screws. The container body 14 has molded or attached to one side a plug 16 which slides into the socket 12 to attach the container body 14 to the wall or vertical surface 10.

The container body 14 can be of cylindrical, rectangular, or other cross-section. In the preferred embodiment shown in FIG. 2, the lower portion of the container body 14 is turned to an angle of about 45 degrees to the main portion of the container body 14 so that the surface of the button 18 faces downward about 45 degrees from the vertical when the container is mounted on a vertical surface.

Figure 5:
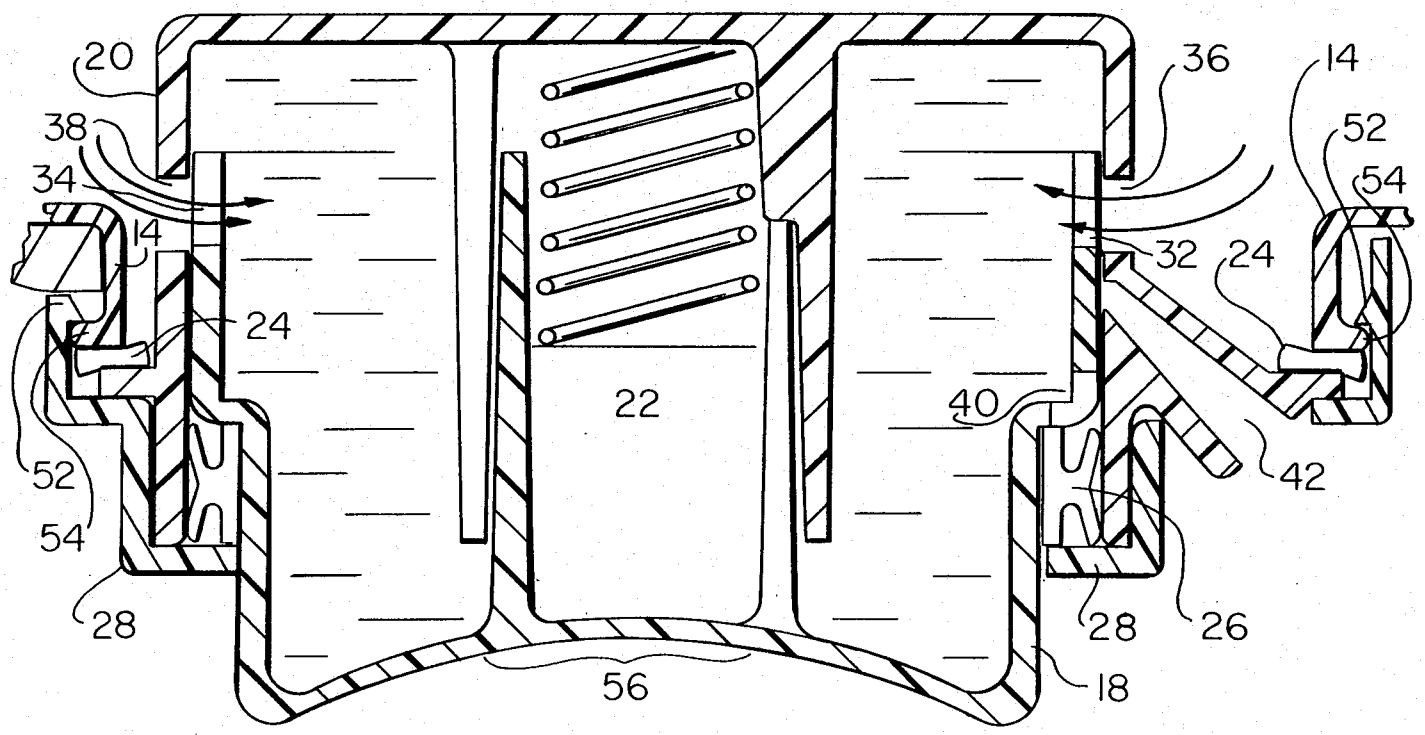
FIG. 5 is a blowup of the pump portion of FIG. 2.
Figure 12:
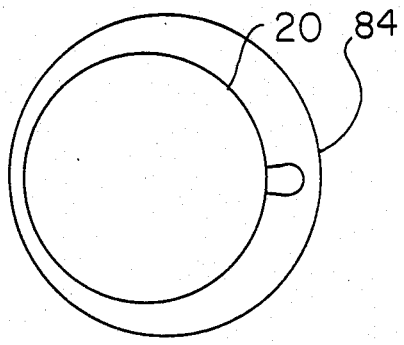
FIG. 12 is a bottom view of the button housing.
Figure 13:
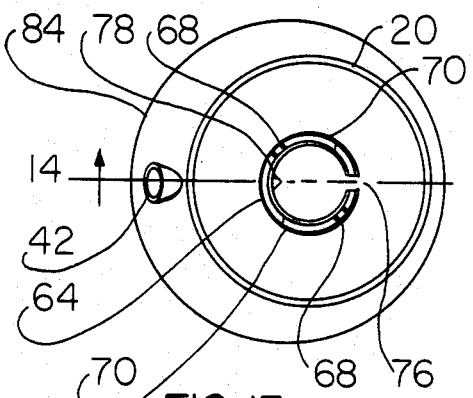
FIG. 13 is a top view of the button housing.
Figure 14:
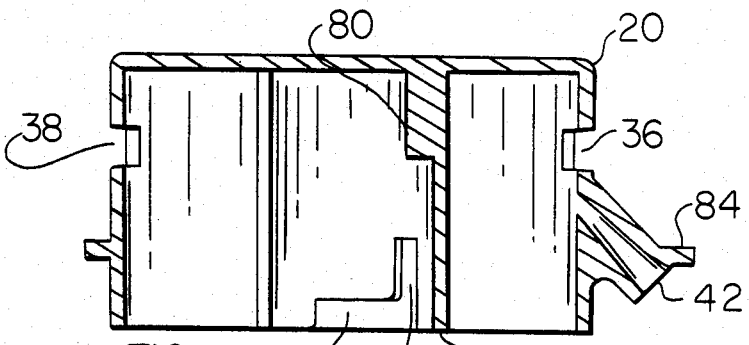
FIG. 14 is an enlarged sectional view of the button housing along the line 14—14 in FIG. 13.
Figure 15:
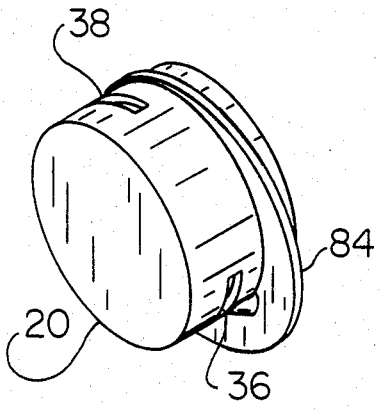
FIG. 15 is a perspective view of the button from the front.
Figure 16:
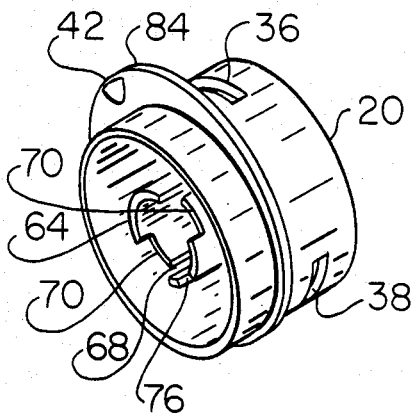
FIG. 16 is a perspective view of the button from the rear.

Referring to FIGS. 3, 4 and 5, the button assembly comprises the button 18, the button housing 20, the spring 22, the seal 24, the X-gasket 26, and the button holder outer cover 28*a* and inner cover 28*b*.

In use, the button 18 is depressed by finger pressure on the surface. As a result of the movement of the button 18 relative to the button housing 20, the grooves 32 and 34 in the button 18 are displaced relative to the slots 36 and 38 in the button housing 20 thereby preventing further flow of the fluid from the container body 14 into the interior of the button 18. Full depression of the button causes the hole 40 to align with the despensing opening 42 and allows the fluid from the interior of the button 18 to be pumped by pressure on the button into the hand of the operator.

Upon release of the button 18, the spring 22 forces the button outward disconnecting hole 40 from dispensing opening 42 and reconnecting groove 32 and slot 36 allowing the inflow of fluid into the interior of the button 18 and reconnecting holes 34 and 38 allowing the venting of air into the container body 14.

The X-gasket 26 shown in FIGS. 1,2, and 5 in cross-section in FIG. 4, prevents flow of the fluid between the button 18 and the button housing 20. The X-gasket is a modified "I" shape in cross-section, with the interior end having the normal "T" end of an "I" and the exterior end modified to be more like a "Y" as shown in FIG. 4.

The seal 24 shown in FIG. 3 aids the sealing of the button holder 28 to the container body 14. The button holder 28 attaches the button assembly 50 to the container body 14 by force fit of a tapered lip 52 on the button holder 28 over a small flange 54 on the dispenser 14.

Referring to FIGS. 5 through 11, the button 18 has a depression 56 in the center of the button 18 to facilitate keeping the user's finger centered on the he button 18 especially when the user's hand is wet. There is a groove 58 in the face of the button 18 from the center of the button 18 to the edge of the face of the button 18 at the point closest to the dispensing hole 40. The groove 58 serves as a marker for orientation for turning the button 18. There is also knurling 60 on the edge of the end of the button 18 to facilitate gripping for turning the button 18.

The button 18 has in the center of its hollow interior a cylindrical tube 62. The hollow cylindrical tube 62 in the button 18 fits inside a cylindrical tube 64 at the center of the hollow interior of the button housing 20. There are short longitudinal ribs 66 on opposite sides of the tube 62 which fit into corresponding slots 68 in the cylinder 64. These ribs 66 and slots 68 prevent the button from rotating while being depressed so as to maintain the proper alignment of the button 18 to the button housing 20. There are shallow wide slots 70 in the tube 64 in the button housing 20. These slots are adjacent to the slots 68 so that when the button is in the non-depressed position the ribs 66 may be rotated from the slots 68 into the slots 70 by rotating the button 18. This rotation of the ribs 66 into the slots 70 prevents the button 18 from being depressed. Thus, when the ribs 66 are in the slots 68 the dispenser is in the "on" position enabling the dispensing of fluid, and when the ribs 66 are in the slots 70 the dispenser is in the "off" position disabling the dispensing of fluid. The "off" position is particularly useful while shipping a fluid-filled dispenser. The interior of the tube 62 has a shoulder 72 and interior ribs 74 to support the spring 22. The tube 64 has a slot 76 to allow fluid to pass from the interior of the tube 64 when the button 18 is depressed. The tube 62 in the button 18 has a slot 78. The tube 64 has a short shallow longitudinal rib 80 on the interior of the tube 64 which fits into the slot 78 to further prevent rotation while depressing the button 18. When the button 18 is turned to the "off" position the rib 80 deforms the tube 64 to slide into the slot 82 thereby latching the button 18 in the "off" position. The advantage of this structure is that sufficient torque is required to turn the button 18 to the "on" position so that the dispenser cannot turn itself "on" due to vibration in shipping.

Referring the FIGS. 12–16, the button housing 20 has a circular flange 84 around the outside of the main body of the button housing. The flange 84 provides support of the button housing 20 when placed into the opening in the container body 14. The flange is not centered on the main body of the button housing in order to provide best support for the dispensing opening 72.

The button holder 28, shown in FIGS. 2, 3 and 17 and through 23, has marked on its exterior the labels "open" and "closed" at the appropriate places so that the groove 58 on the button 18 points to the appropriate label as the button 18 is turned. The button holder 28 has an opening 86 through which the dispensing opening 42 passes when the dispenser is assembled; this arrangement also serves to uniquely orient the button holder 28 to the button housing 20. There is a notch 88 in the edge of the button holder 28 which fits over a bump 90 on the container body 14 to orient the button holder to the container body. Thus, every piece in the dispensing container, excepting the spring 22 seal 24 and gasket 26, is keyed to the next piece to provide a unique orientation of the assembly.

Figure 24:
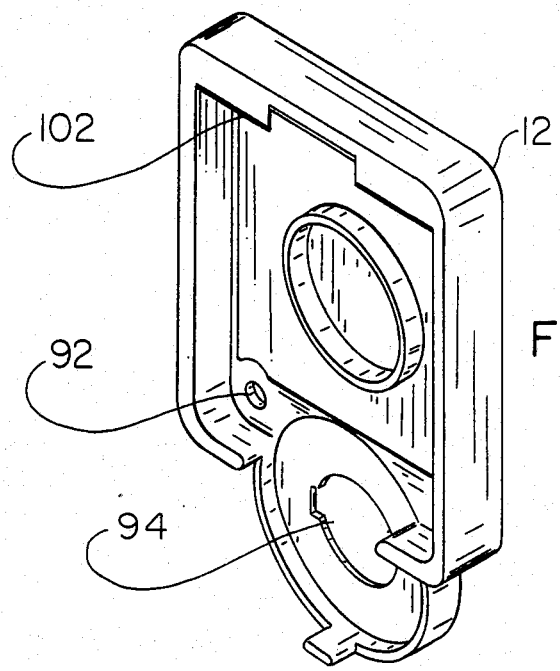
FIG. 24 is a perspective view of the bracket from the front.
Figure 25:
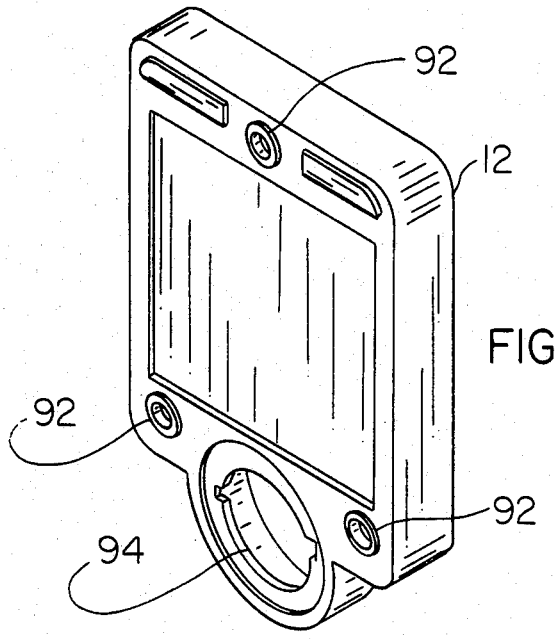
FIG. 25 is a perspective view of the bracket from the rear.

The socket 12 is shown in FIGS. 24 from the front and 25 from the rear. Three small holes 92 are shown to permit attachment of the socket 12 to the wall with fasteners such as screws or nails. A large hole 94 is provided near the bottom of the socket 12 for insertion of the latch 96 from the rear of the socket 12. The flange 98 on the latch is larger than the large hole 94. The latch 96 has a large tab 100. When the plug 16 on the container body 14 is inserted into the socket 12, the upper part of the plug 16 fits under the lip 102 on the socket 12 and the lower part of the plug 16 is held by rotating the latch 96, and thereby the large tab 100, until the plug 16 rests on the two tab supports 104. The latch 96 has a small tab 106 to hold the latch 96 in the large hole 94 in the socket 12. The latch 96 has two rectangular openings 108 on opposite sides of the latch 12. There is a button 110 at the center of the interior of the latch 12. The button 110 has a small dimple 112 in the center. The latch 96 is rotated by inserting either the lever 114 or the tool 116 through the rectangular openings 108. The lever 114 or the tool 116 is then used as a handle to rotate the latch 96. The lever 114 is intended for use in the home and is to be inserted and left in place. In public places there is a potential problem of the lever being used by unauthorized persons to remove the dispenser. In public places, then, the lever 114 is not used. Rather, the authorized attendant uses the tool 116 to change the dispenser and takes the tool 116 away. Unauthorized persons are thereby hindered from rotating the latch 96 and taking the dispenser. The tip 118 of the lever 114 has a channel shape to slide over the button. There is a bump 120 on the tip 118 of the lever 114 which snaps into the dimple 112 on the button 110 on the latch 96. The tip 122 of the tool 116 has a channel shape like that of the lever 114 but does not have a corresponding bump.

Figure 37:
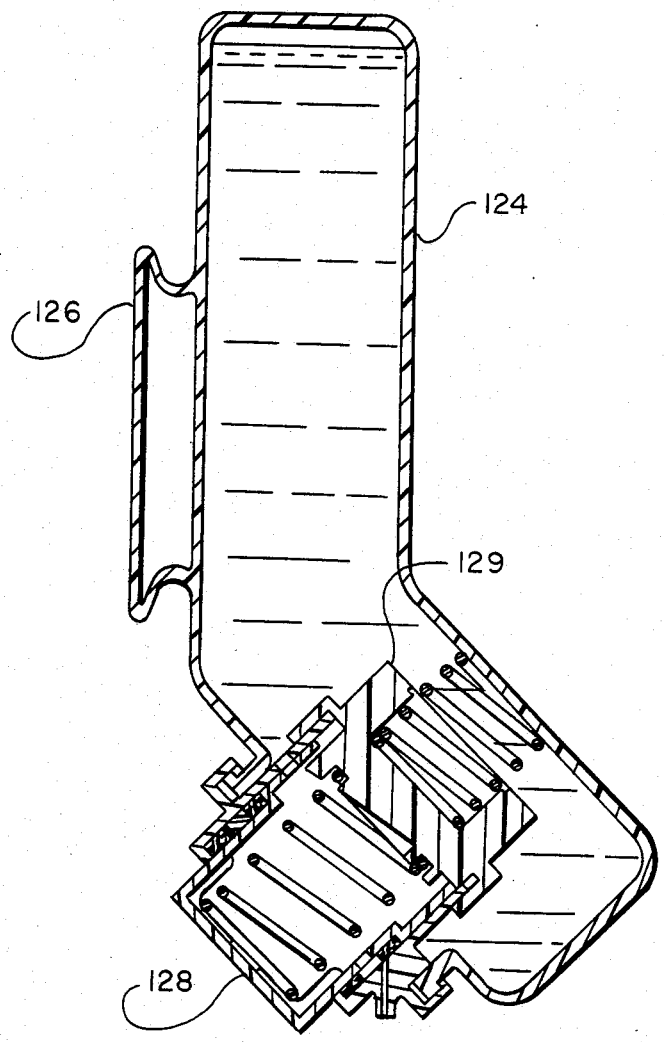
FIG. 37 is a section along line 2—2 for an alternative embodiment of the invention.

In FIG. 37, container body 124 has molded or attached to one side a plug 126 which slides into the socket 12 to attach the container body 124 to the wall or vertical surface 10. In this alternative preferred embodiment shown in FIG. 37, the lower portion of the container body 124 is also turned to an angle of about 45 degrees to the main portion of the container body 124 so that the surface of the button 128 faces downward about 45 degrees from the vertical when the container is mounted on a vertical surface.

Figure 38:
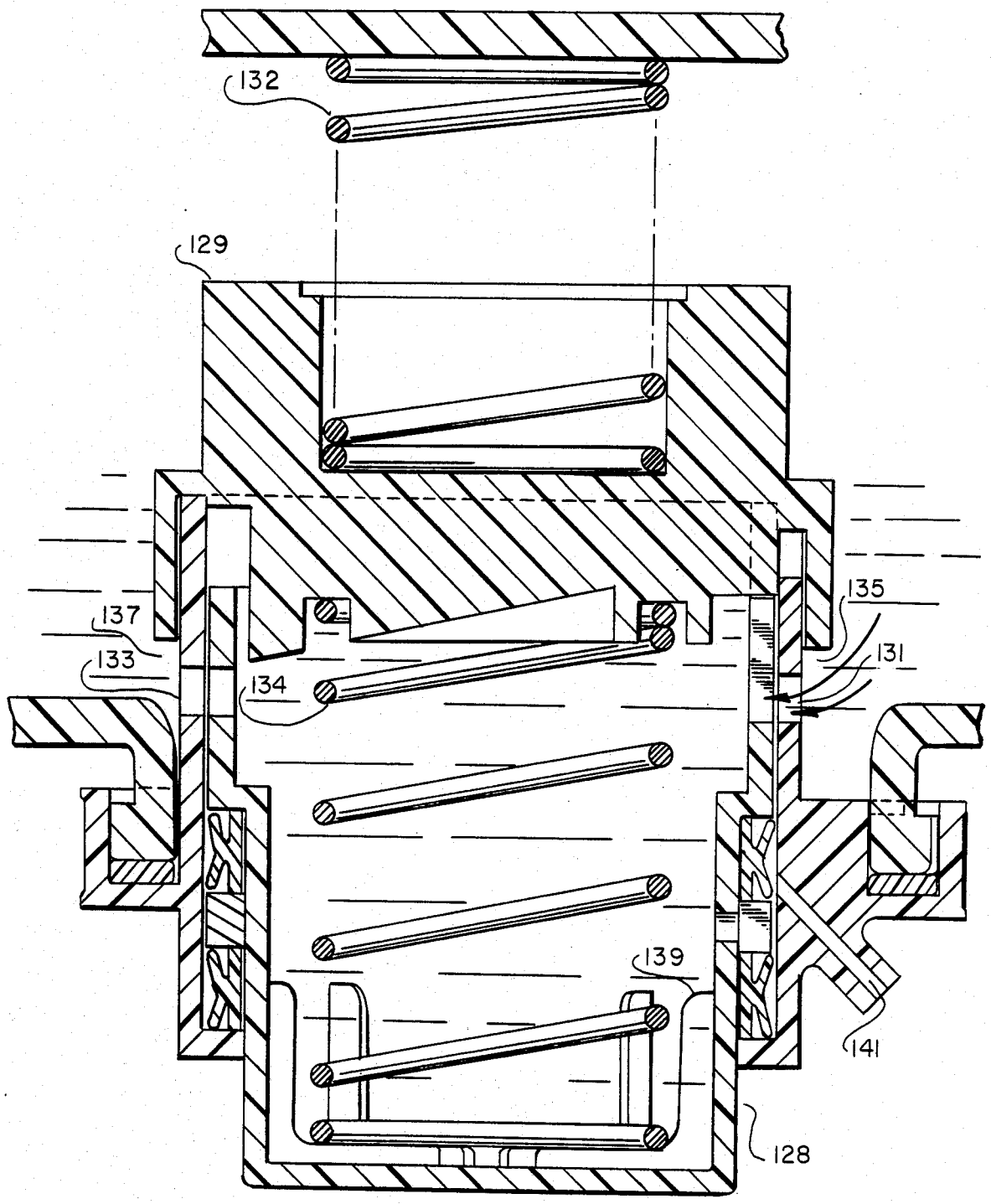
FIG. 38 is a blowup of the pump portion of FIG. 37.
Figure 39:
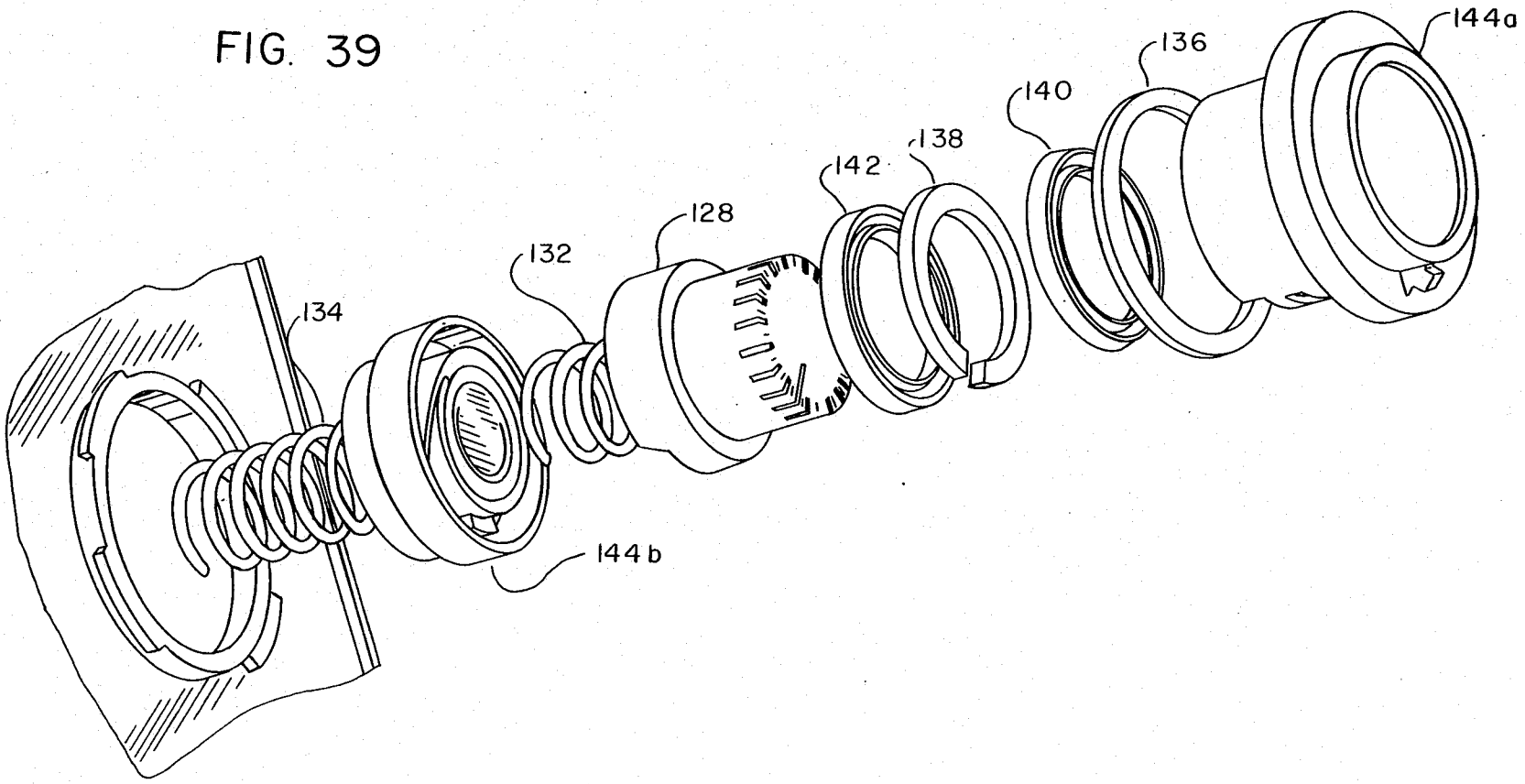
FIG. 39 is a blowup of the drawing of the button of FIGS. 37 and 38.

Referring to FIGS. 37, 38 and 39, the button assembly comprises the button 128, the button housing 129, springs 132 and 134, seals 136 and 138, X-gaskets 140 and 142, button holder other cover **144*a* and inner cover 144*b***.

In operation, button 128 is depressed, and as a result of the button movement relative to the button housing 129, grooves 131 and 133 in the button 128 are displaced relative to the slots 135 and 137 in button housing 129 thereby preventing further flow of the fluid from the container body into the interior of the button 128. Complete depression of the button causes the hole 139 to align with dispensing opening 141 to allow the fluid from the interior of button 128 to be pumped by pressure on the button into the hand of the operator.

Upon release of button 128, upper spring 132 and lower spring 134 forces the button outward disconnecting hole 139 from dispensing opening 141 and reconnecting groove 131 and slot 136 to allow the inflow of fluid into the interior of button 128 and reconnecting holes 133 and 137 to allow venting of air into the container body. The inclusion of upper and lower springs, which together store and convert more energy than a single spring, allows a faster fluid inflow rate into the interior of the button upon release.

The container and button assembly may be made of various plastics, glass or metal as may be suitable and economical.

This invention is not limited to the embodiments heretofore described, to which variations and improvements may be made, consisting of mechanically equivalent modification to component parts, without leaving the scope of protection of the present patent, the characteristics of which are summarized in the following claims.

What is claimed is:

1. A disposable dispenser suitable for mounting on a vertical surface comprising:

a disposable container;

a disposable plug attached to said container;

a socket attached to a vertical surface and into which said plug fits;

a latch means within said socket capable of being manipulated to hold said plug;

a cylindrical hollow button housing fitted near the bottom of said container having slots communicating between the interior of said container and the interior of the button housing and said button housing having a dispensing opening between the interior of said button housing and the exterior;

a hollow cylindrical button fitting snugly into said button housing and having an opening such that on pressing said button said slots between the interior of said button housing and the interior of said container are blocked and said opening in said button moved in proximity to said dispensing opening whereby to allow communication of fluid between the interior of said button and the exterior;

a spring means between said button and said button housing for restoring said button to its most outwardly extended position;

a locking means for preventing the inward movement of said button; and a latching means for securely holding said locking means in a disabled position.

2. The dispenser of claim 1, wherein said spring means consist of an upper spring and a lower spring.

3. The dispenser of claim 1, wherein said container is shaped with the button mounted pointing downward at an angle of about 45 degrees to the vertical.

* * * * *